US006082728A

United States Patent [19]

Ubayashi

[11] Patent Number: 6,082,728

[45] Date of Patent: Jul. 4, 2000

[54] SHEET FEEDING APPARATUS

[75] Inventor: Shinsuke Ubayashi, Yokohama, Japan

[73] Assignee: Canon Kabushiki Kaisha, Tokyo, Japan

[21] Appl. No.: 08/988,353

[22] Filed: Dec. 10, 1997

Related U.S. Application Data

[63] Continuation of application No. 08/313,561, Sep. 29, 1994, abandoned.

[30] Foreign Application Priority Data

Oct. 1, 1993 [JP] Japan ..... 5-269785

[51] Int. Cl.[7] ..... B65H 3/08

[52] U.S. Cl. ..... 271/108; 271/105; 271/106; 271/11; 271/90

[58] Field of Search ..... 271/94, 105, 106, 271/11, 96, 90, 108

[56] References Cited

U.S. PATENT DOCUMENTS

| | | | |
|---|---|---|---|
| 4,014,537 | 3/1977 | Stange . | |
| 4,184,672 | 1/1980 | Watkins et al. | 271/108 |
| 4,382,593 | 5/1983 | Beran et al. . | |
| 4,432,540 | 2/1984 | Akers et al. . | |
| 4,451,028 | 5/1984 | Holmes et al. . | |
| 4,596,385 | 6/1986 | Silverberg . | |
| 4,627,605 | 12/1986 | Roller et al. . | |
| 5,090,676 | 2/1992 | Matsuno et al. . | |
| 5,139,253 | 8/1992 | Bohme et al. . | |
| 5,167,407 | 12/1992 | Namba . | |
| 5,181,710 | 1/1993 | Takata et al. . | |
| 5,234,207 | 8/1993 | Lindstrom et al. . | |
| 5,645,274 | 7/1997 | Ubayashi et al. | 271/108 |
| 5,685,534 | 11/1997 | Zeltner | 271/108 |

FOREIGN PATENT DOCUMENTS 07101579 7/1995 Japan .

*Primary Examiner*—Christopher P. Ellis
*Assistant Examiner*—Khoi H. Tran
*Attorney, Agent, or Firm*—Fitzpatrick, Cella, Harper & Scinto

[57] ABSTRACT

A sheet feeding apparatus has a sheet supporting device for supporting a plurality of sheets, a sheet absorb device for absorbing by air suction the uppermost of the sheets, and a convey device for conveying the absorbed sheet. A contact preventing air blowing device injects air between the uppermost sheet absorbed by the sheet absorb device and the next sheet to keep the next sheet from being conveyed while the absorbed sheet is being conveyed, and an air adjusting device increases or decreases an amount of air injected from the contact preventing air blowing device during conveyance of the sheet.

13 Claims, 12 Drawing Sheets

SHEET FEEDING APPARATUS

This is a continuation application of U.S. application Ser. No. 08/313,561, originally filed on Sep. 29, 1994, now abandoned.

BACKGROUND OF THE INVENTION

1. Field of the Invention

The present invention relates to a sheet feeding apparatus used with an image forming apparatus such as an electrophotographic copying machine. More particularly, it relates to an air sheet feeding apparatus for separating and supplying a sheet one by one from a sheet stack rested on a sheet tray by utilizing an air suction force.

2. Related Background Art

Among conventional sheet feeding apparatuses used an image forming apparatus such as an electrophotographic copying machine and the like, a sheet feeding apparatus of roller type wherein sheets stacked on a sheet tray are separated one by one by rotation of a sheet supply roller and the separated sheet is conveyed downstreamly has widely been used. In such a conventional sheet feeding apparatus, a surface of the sheet supply roller is formed from an elastic body such as rubber having high coefficient of friction which mainly determines feeding ability of the roller. Accordingly, the feeding ability of the roller was unstable since the coefficient of friction of the roller surface was changed because of the change in configuration of the roller due to wear, deterioration of material of which the roller is made and/or adhesion of paper powder to the roller surface, and the conventional roller could not cope with various kinds of sheets having different surface features. To eliminate the above drawbacks, there has been proposed an air sheet feeding apparatus wherein a sheet is absorbed and conveyed by utilizing a suction force of air.

FIG. 11 shows a typical conventional air sheet feeding apparatus. In FIG. 11, a plurality of sheets S0 are stacked on a sheet tray 101 in such a manner that tip ends of the sheets S0 are abutted against a sheet align guide plate 112. A sheet convey portion 100 is arranged above the sheet tray 101 on which the sheets are stacked. The sheet convey portion 100 includes a sheet absorb portion 102, a convey belt 103 having a plurality of absorb holes 103*a*, a belt drive roller 104 for driving the convey belt 103 in a direction shown by the arrow A, a driven roller 111 on which the convey belt 103 is mounted, and a blower 104 for sucking air through the absorb holes 103*a* and the sheet absorb portion 102.

The suction of the blower 104 is turned ON/OFF by a valve 109. In order to float the sheets, there is arranged a nozzle 105 for injecting air toward a tip end of the sheet stack rested on the sheet tray obliquely and upwardly in a direction shown by the arrow B. The nozzle 105 is connected to a blower 107 so that the air is supplied to the nozzle.

Such an air sheet feeding apparatus is operated as follows. First of all, the air is injected from the nozzle 105 under the action of the blower 107 to float several sheets from the sheet stack rested on the sheet tray. Then, the uppermost sheet is absorbed to the convey belt 103 under the action of the blower 104 by opening the valve 109. Thereafter, the convey belt 103 is driven to convey the sheet downstreamly to a pait of convey rollers 108. Thereafter, the valve 109 is closed and the convey belt 103 is stopped.

However, in the above-mentioned conventional sheet feeding apparatus, when a first sheet S1 is supplied, there arose the following problem after a trailing end of the first sheet S1 has passed through below the driven roller 111. That is to say, a second sheet S2 is excessively floated by the action of the nozzle 105, so that, as shown in FIG. 12, before the feeding of the first sheet S1 is finished, the second sheet S2 is contacted with the moving convey belt 103 which is not covered by the first sheet S1, with the result that the tip end of the second sheet is strongly struck against the sheet align guide plate 112.

Consequently, the tip end portion of the second sheet S2 is bent or folded. Accordingly, when the second sheet S2 is supplied, the tip end portion of the second sheet cannot be absorbed to the sheet absorb portion 102 completely, thereby causing the poor sheet feeding. This problem frequently occurred in light sheets having relatively small rigidity.

SUMMARY OF THE INVENTION

An object of the present invention is to provide a sheet feeding apparatus for feeding a sheet by utilizing air suction, wherein a second sheet is prevented from being absorbed while a first sheet is being supplied.

To achieve the above object, according to the present invention, there is provided a sheet feeding apparatus comprising a sheet supporting means for supporting a plurality of sheets, a sheet absorb means for absorbing the sheet supported by the sheet supporting means under the action of air suction, a convey means for conveying the sheet absorbed by the sheet absorb means, a contact preventing air blowing means for injecting air between the sheet absorbed by the sheet absorb means and a next sheet so that the next sheet is not conveyed by the convey means while the sheet absorbed by the sheet absorb means is being conveyed by the convey means, thereby preventing contact between the next sheet and the convey means, and an air adjusting means for increasing or decreasing an amount of air injected from the contact preventing air blowing means during conveyance of the sheet.

The adjustment of the air amount may be effected by increasing the amount of the air injected between the absorbed sheet and the next sheet before an entire absorb surface of the sheet absorb means is not wholly covered by the sheet and by decreasing the amount of the injected air after the convey means is stopped.

By adjusting the amount of air injected from the contact preventing air blowing means in this way, the poor absorption is prevented, thereby feeding the sheet stably and hastening the absorb operation to achieve the high speed sheet separation and sheet supply.

DETAILED DESCRIPTION OF THE PREFERRED EMBODIMENTS

Figure 1:
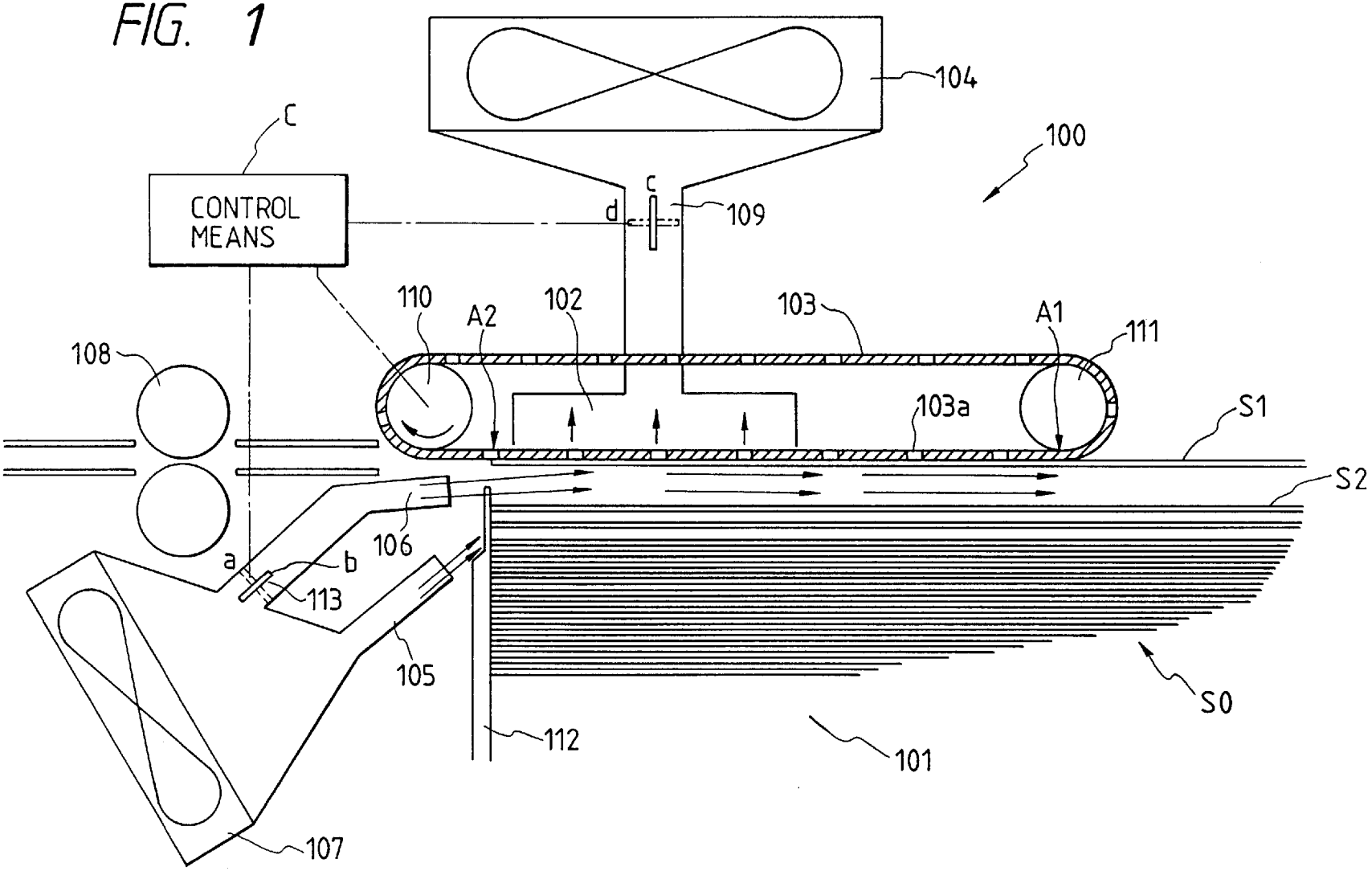
FIG. 1 is an elevational sectional view of a sheet feeding apparatus according to a first embodiment of the present invention.
Figure 11:
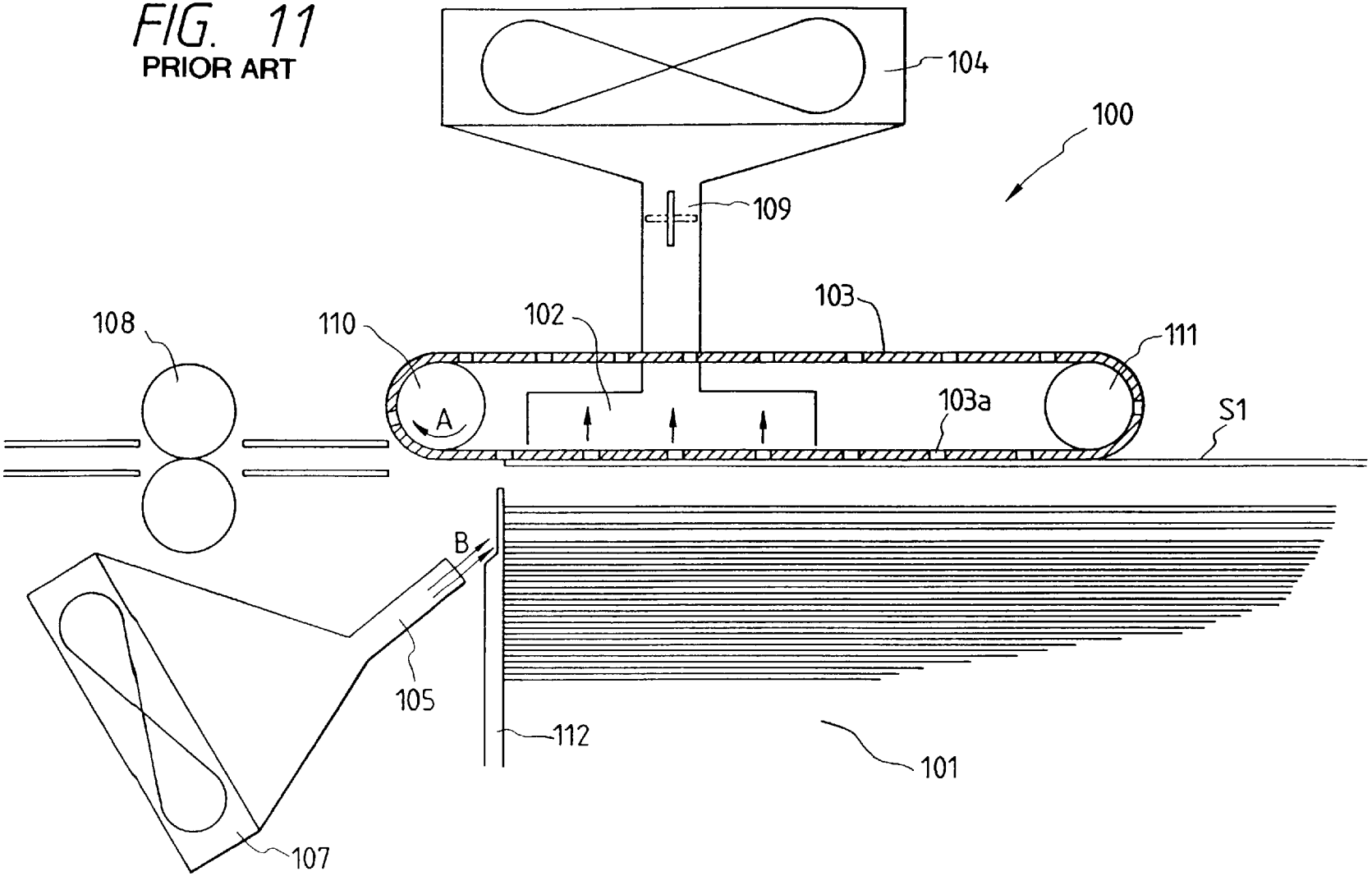
FIG. 11 PRIOR ART
FIG. 11 is an elevational sectional view of a conventional sheet feeding apparatus.
Figure 12:
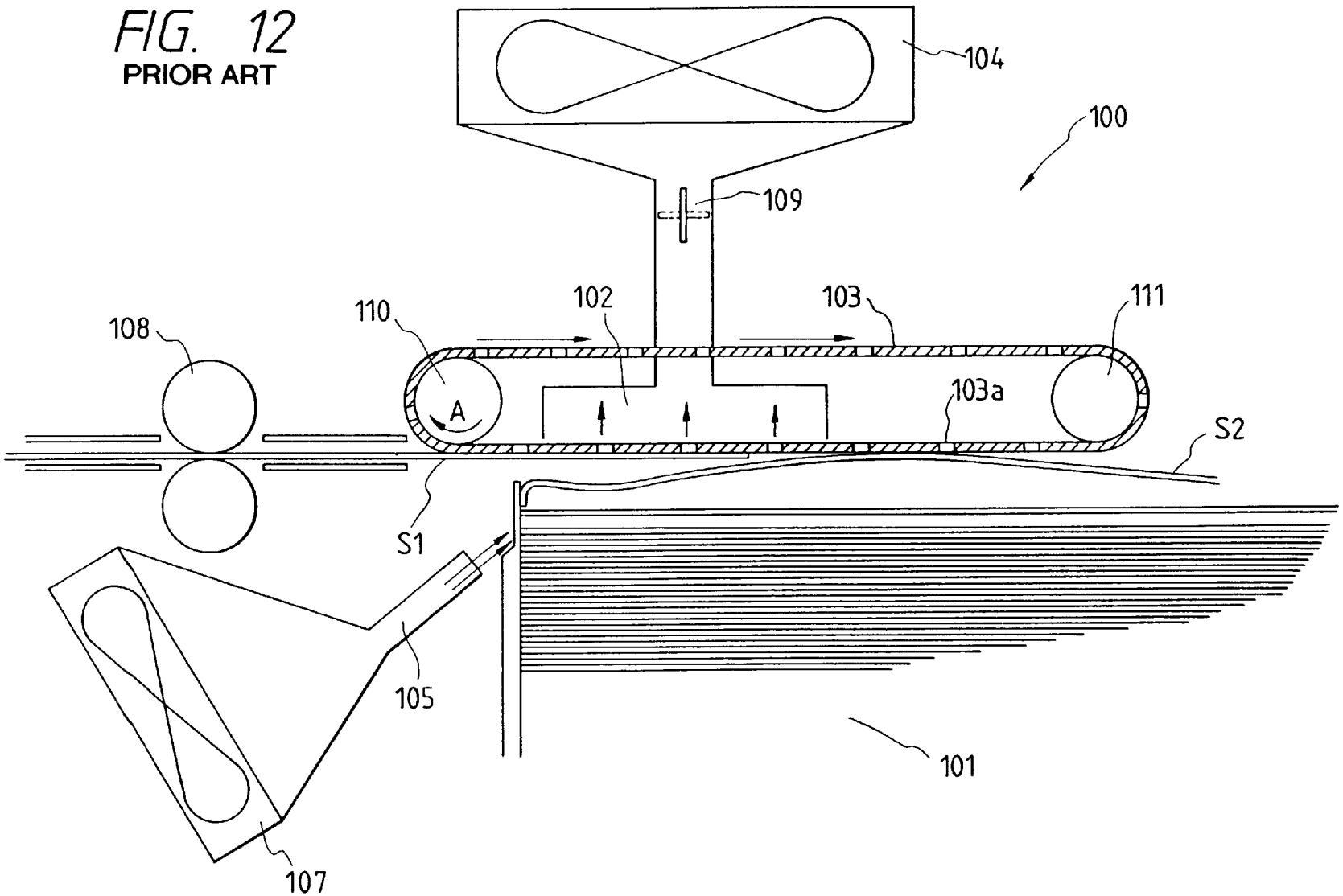
FIG. 12 PRIOR ART
FIG. 12 is a view similar to FIG. 11, showing a problem caused by the apparatus of FIG. 11.

The present invention will now be explained in connection with embodiments thereof with reference to the accompanying drawings. FIG. 1 is an elevational sectional view of an air sheet feeding apparatus according to a first embodiment of the present invention. The same elements as those of the conventional sheet feeding apparatus shown in FIG. 11 are designated by the same reference numerals and explanation thereof will be omitted.

A contact prevent nozzle 106 serves to inject or discharge air toward a tip end of a sheet absorbed to a sheet absorb portion (suction chamber) 102. A contact prevent valve 113 is normally closed to assume a position a. When the valve is opened to a position b, air is supplied from a blower 107 to the contact prevent nozzle 106.

Now, an operation of the sheet feeding apparatus will be explained. First of all, the blowers 107, 104 are activated. Consequently, the air is discharged from a nozzle 105 under the action of the blower 107 to float several sheets from a sheet tray 101. When a valve 109 is opened to a position c, a first sheet S1 is absorbed to a convey belt (convey means) 103 under the sucking action of the blower 104.

Then, the contact prevent valve 113 is opened to the position b so that the air is injected between the first sheet S1 and a second sheet S2. Then, the convey belt 103 is driven to convey the first sheet S1 alone to a pair of convey rollers 108. When a trailing end of the first sheet S1 passes through the sheet absorb portion 102, the convey belt 103 is stopped. Then, the contact prevent valve 113 is closed and the air discharge from the contact prevent nozzle 106 is also stopped. However, since the air continues to be discharged from the contact prevent nozzle 106 to prevent the second sheet S2 from contacting with the convey belt 103 until the valve 113 is closed, the problem described in connection with the conventional sheet feeding apparatus does not occur.

Then, the valve 109 is closed to disappear the suction force of the sheet absorb portion 102. When the second sheet S2 is supplied, the valve 109 is opened again to act the air suction on the sheet absorb portion 102. In this case, if the air is discharged from the contact prevent nozzle 106, since the air flows into the sheet absorb portion 102 not to provide the sufficient absorbing force, the sheet will not be absorbed to the sheet absorb portion 102 or it takes a long time to absorb the sheet to the sheet absorb portion (if the sheet can be absorbed to the sheet absorb portion), thereby increasing the continuous sheet supplying time and causing unstable absorption.

However, in the present invention, in such a case, since the air is not discharged from the contact prevent nozzle 106, the second sheet S2 is stably absorbed to the convey belt 103. Thereafter, the second sheet is supplied in the same manner as the first sheet.

Figure 7:
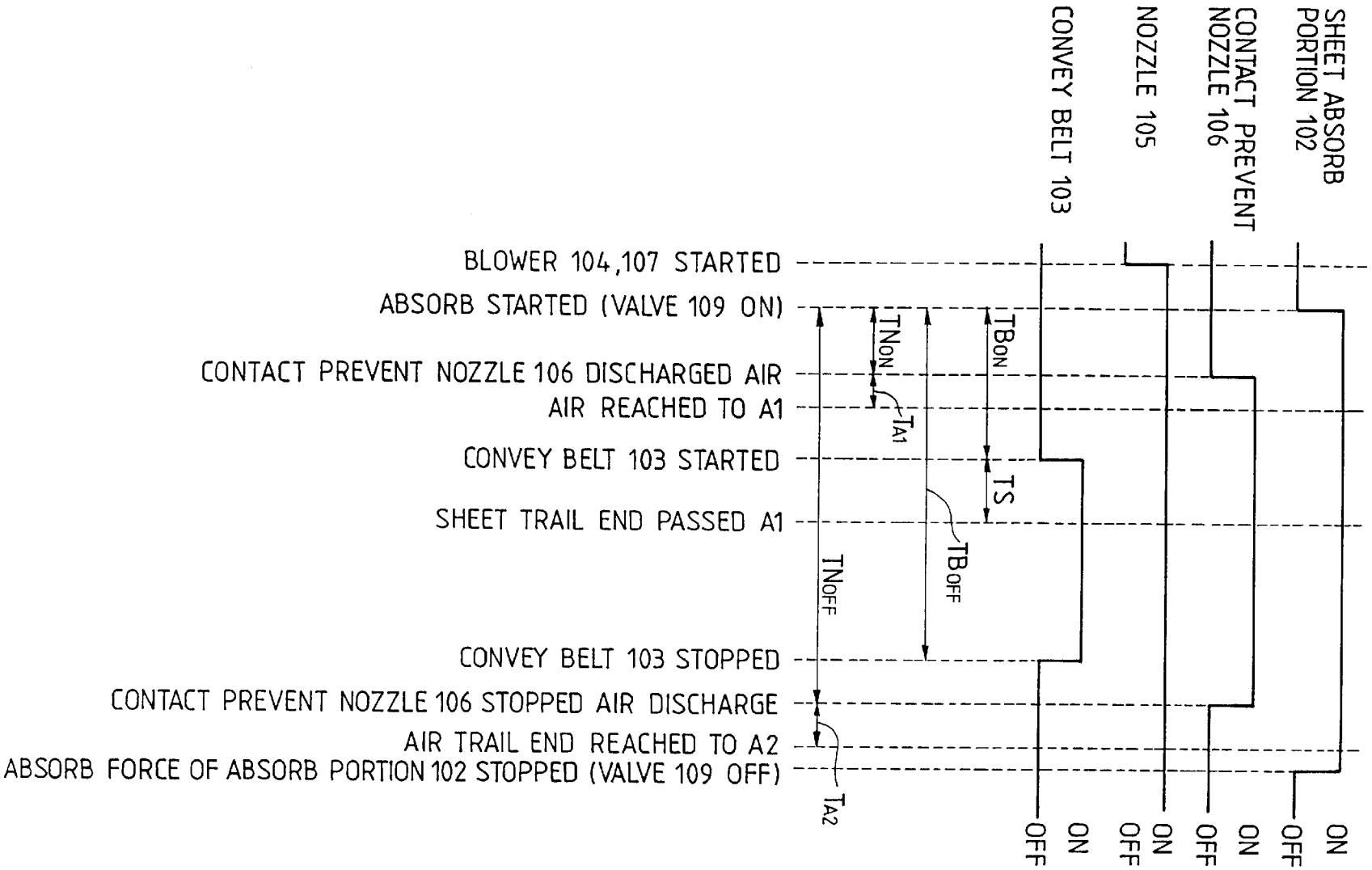
FIG. 7 is a timing chart for explaining an operation of the sheet feeding apparatus according to the first embodiment.

Next, an operation timing between the convey belt 103 and the contact prevent nozzle 106 will be explained with reference to FIG. 7.

Figure 2:
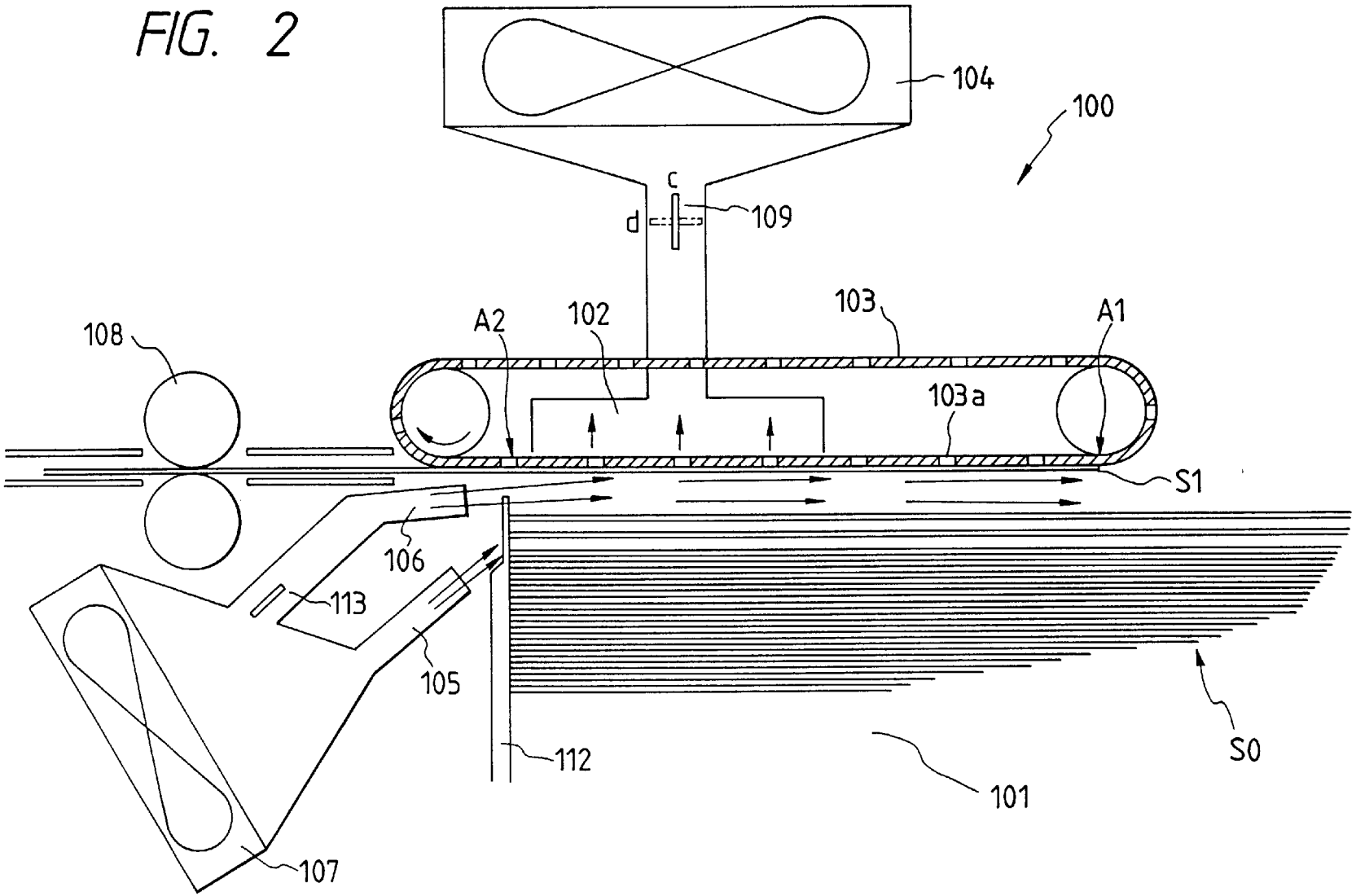
FIG. 2 is a view similar to FIG. 1, showing a condition that a trailing end of a sheet conveyed by a convey belt reaches a rear end of a contact area between the sheet and the convey belt.
Figure 3:
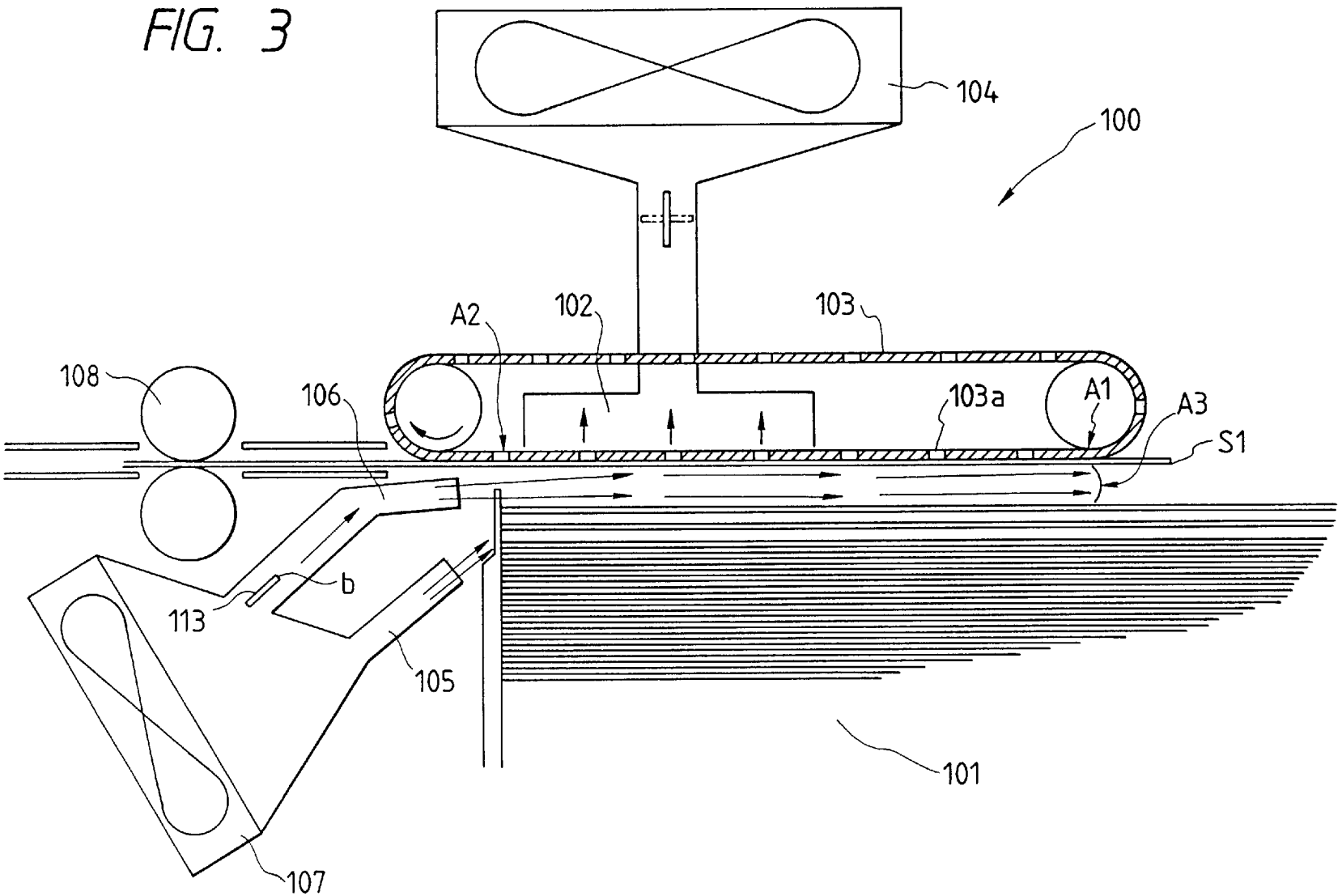
FIG. 3 is a view similar to FIG. 1, showing a condition that air injected from a contact preventing air blowing means (after an amount of injected air is increased) reaches the rear end of the contact area between the sheet and the convey belt.

It is assumed that a time period from the initiation of the absorption of the sheet absorb portion 102 to the initiation of the air discharge from the contact prevent nozzle 106 is $TN_{ON}$, a time period from the initiation of the absorption of the sheet absorb portion to the end of the air discharge from the contact prevent nozzle 106 is $TN_{OFF}$, a time period from the initiation of the absorption of the sheet absorb portion to the initiation of movement of the convey belt 103 is $TB_{ON}$, and a time period from the initiation of the absorption of the sheet absorb portion to the stop of the convey belt 103 is $TB_{OFF}$. Further, it is assumed that a time period from the initiation of movement of the convey belt 103 to the passage of the trailing end of the sheet just below the driven roller 111 (A1 in FIG. 2) is TS.

Figure 4:
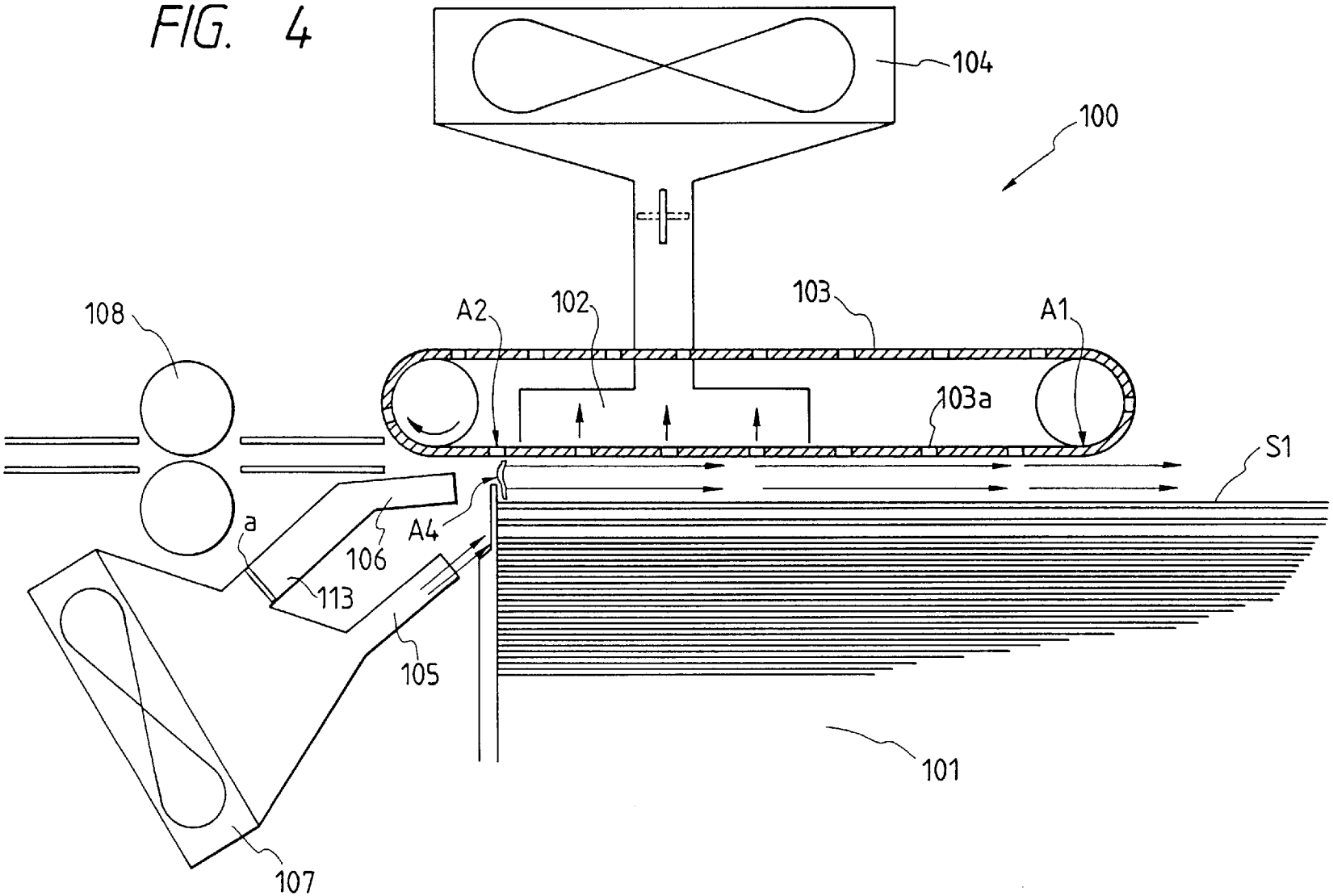
FIG. 4 is a view similar to FIG. 1, showing a condition that air injected from the contact preventing air blowing means (after an amount of injected air is decreased) reaches a front end of the contact area between the sheet and the convey belt.

Further, it is assumed that a time period from the initiation of the air discharge from the contact prevent nozzle 106 to the reach of the front end (A3) of the discharged air to the position A1 is TA1 and a time period from the stop of the air discharge from the contact prevent nozzle 106 to the reach of the rear end (A4) of the air discharged toward a front end (tip end A2 of the sheet in FIG. 4) of the contact area between the sheet and the convey belt 103 is TA2.

Figure 5:
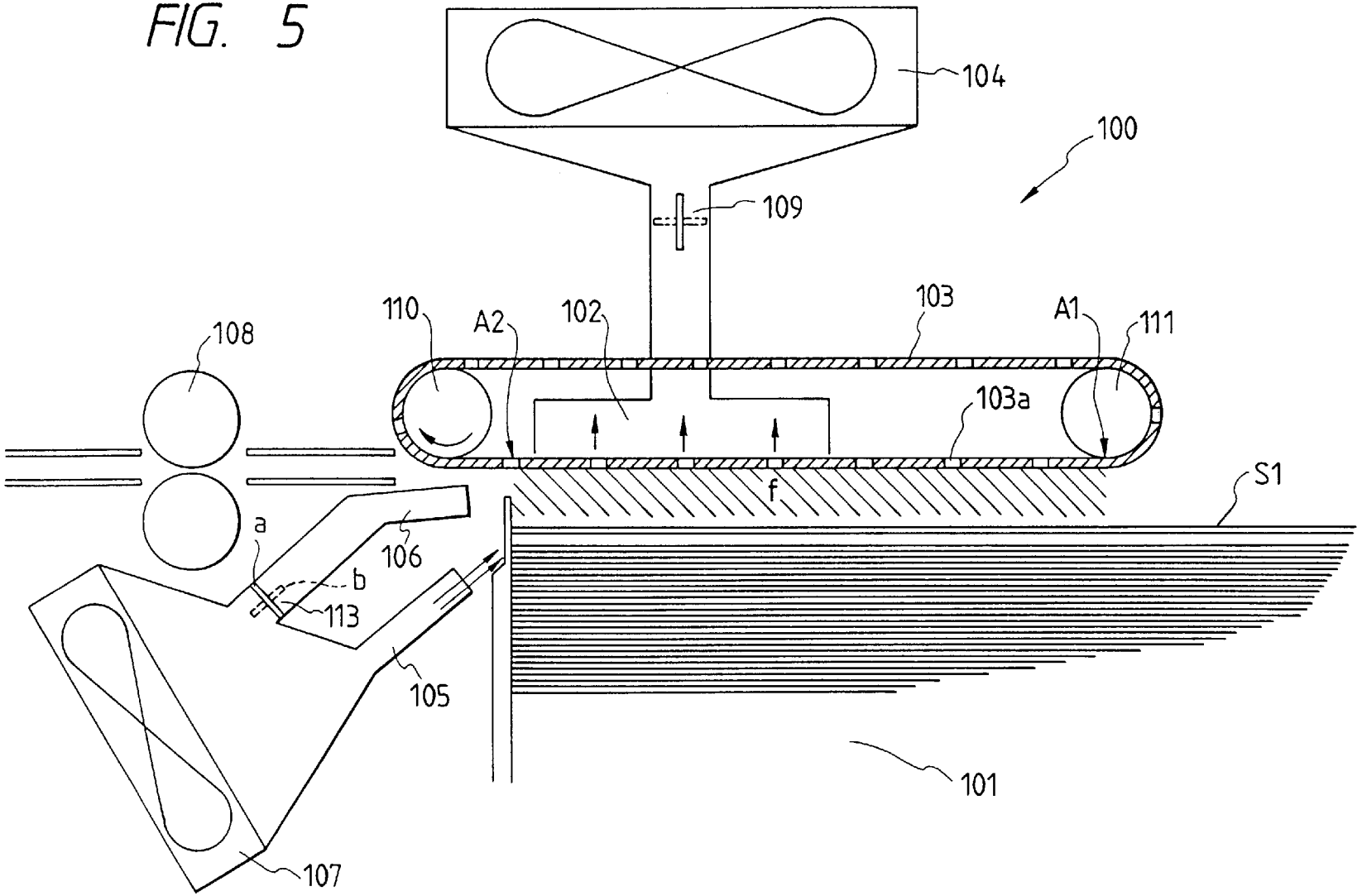
FIG. 5 is a view similar to FIG. 1, showing an area f into which the air is injected from the contact preventing air blowing means.

During the conveyance of the first sheet S1, while the convey belt 103 is being moved, since the air from the contact prevent nozzle 106 must be discharged into an area (hatched area f in FIG. 5) between the first and second sheets in order to prevent the second sheet S2 (which should not be conveyed) from contacting with the convey belt 103, the following two relations must be satisfied:

$$TN_{ON}+TA1 \leqq TB_{ON}+TS \quad \text{(i)}$$

$$TB_{OFF} \leqq TA2+TN_{OFF} \quad \text{(ii)}$$

The relation (i) represents the fact that a time period ($TN_{ON}$+TA1) during which the air discharged from the contact prevent nozzle 106 reaches the point A1 (i.e., the discharged air fills the area f) is shorter than a time period ($TB_{ON}$+TS) during which the trailing end of the sheet passes through the point A1 and the convey belt 103 starts to be exposed to the second sheet S2. On the other hand, the relation (ii) represents the fact that a time ($TB_{OFF}$) is shorter than a time period (TA2+TN) during which the air discharged from the contact prevent nozzle 106 cannot cover the area f completely.

By turning ON/OFF the air from the contact prevent nozzle 106 at the above-mentioned timing, while the first sheet S1 is being conveyed, the convey belt 103 is not contacted with the second sheet S2, and, when the second sheet is then absorbed, the second sheet can be absorbed immediately and stably, thereby supplying the sheets continuously at a high speed.

In the illustrated embodiment, in a series of sheet supplying operations, although the suction force of the sheet absorb portion 102 is turned ON/OFF by means of the valve 109 to control whether the absorbing force is given to the sheet absorb portion 102 or not, since the air discharged from the contact prevent nozzle 106 can be turned ON/OFF to control whether the sheet is absorbed to the sheet absorb portion 102 or not, the stable sheet supply can be effected with the valve 109 turned ON (i.e. without the valve 109 itself).

Figure 6:
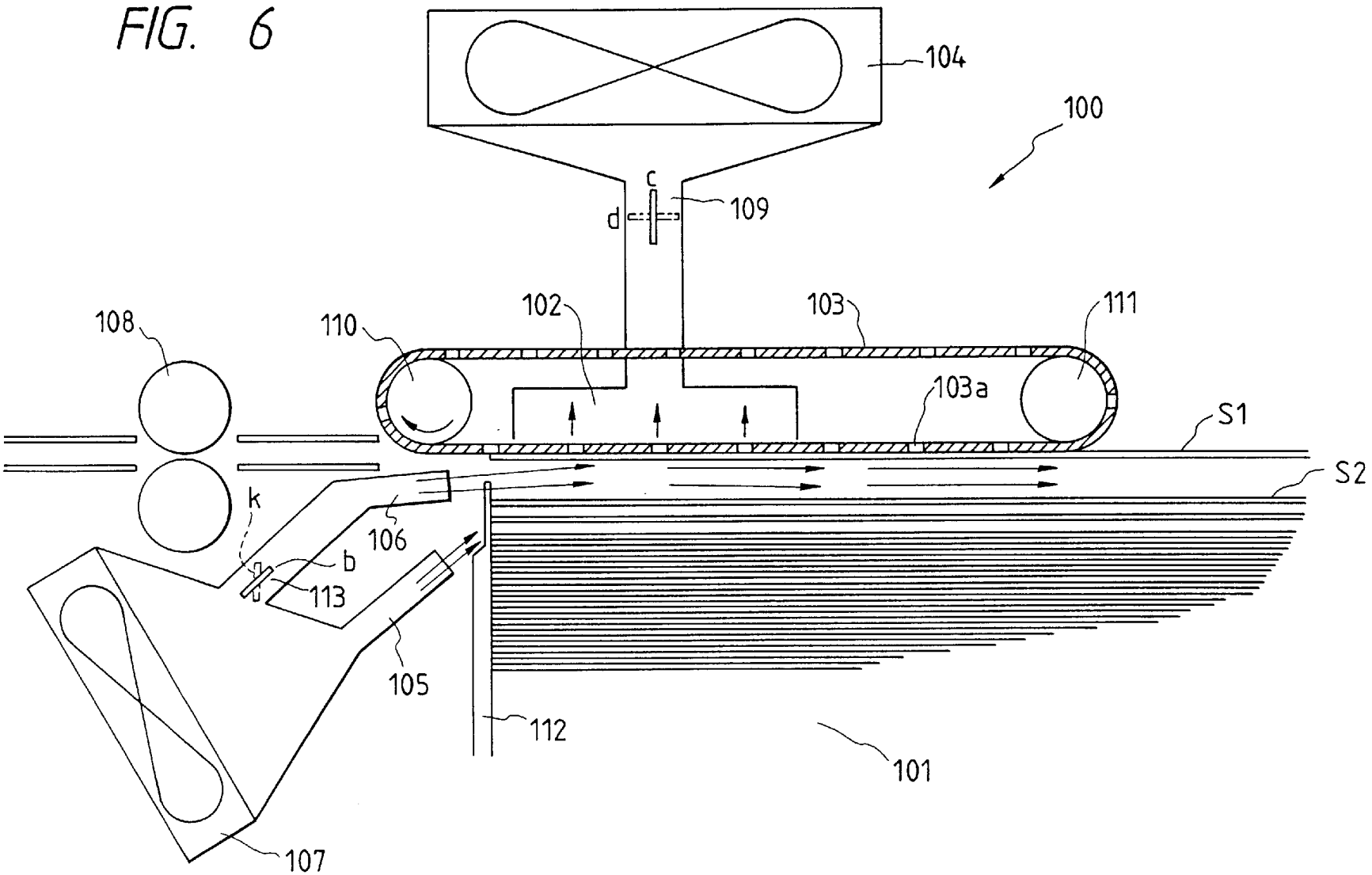
FIG. 6 is a view similar to FIG. 1, showing a condition that the air is injected from the contact preventing air blowing means even after a contact preventing valve is closed.

Further, in the illustrated embodiment, while an example that the air is not discharged from the contact prevent nozzle 106 at all when the contact prevent valve 113 is closed was explained, when the sheet is to be absorbed to the sheet absorb portion 102, a little amount of air may be discharged from the nozzle by slightly opening the contact prevent valve 113, as shown by "k" in FIG. 6, so long as the absorption of the sheet is not prevented. By doing so, the opening/closing movement of the contact prevent valve 113 can respond more quickly. Incidentally, the opening/closing operations of the valve 109 and the contact prevent valve 113 and the conveying operation of the convey belt 103 can be appropriately controlled by a control means C.

Figure 8:
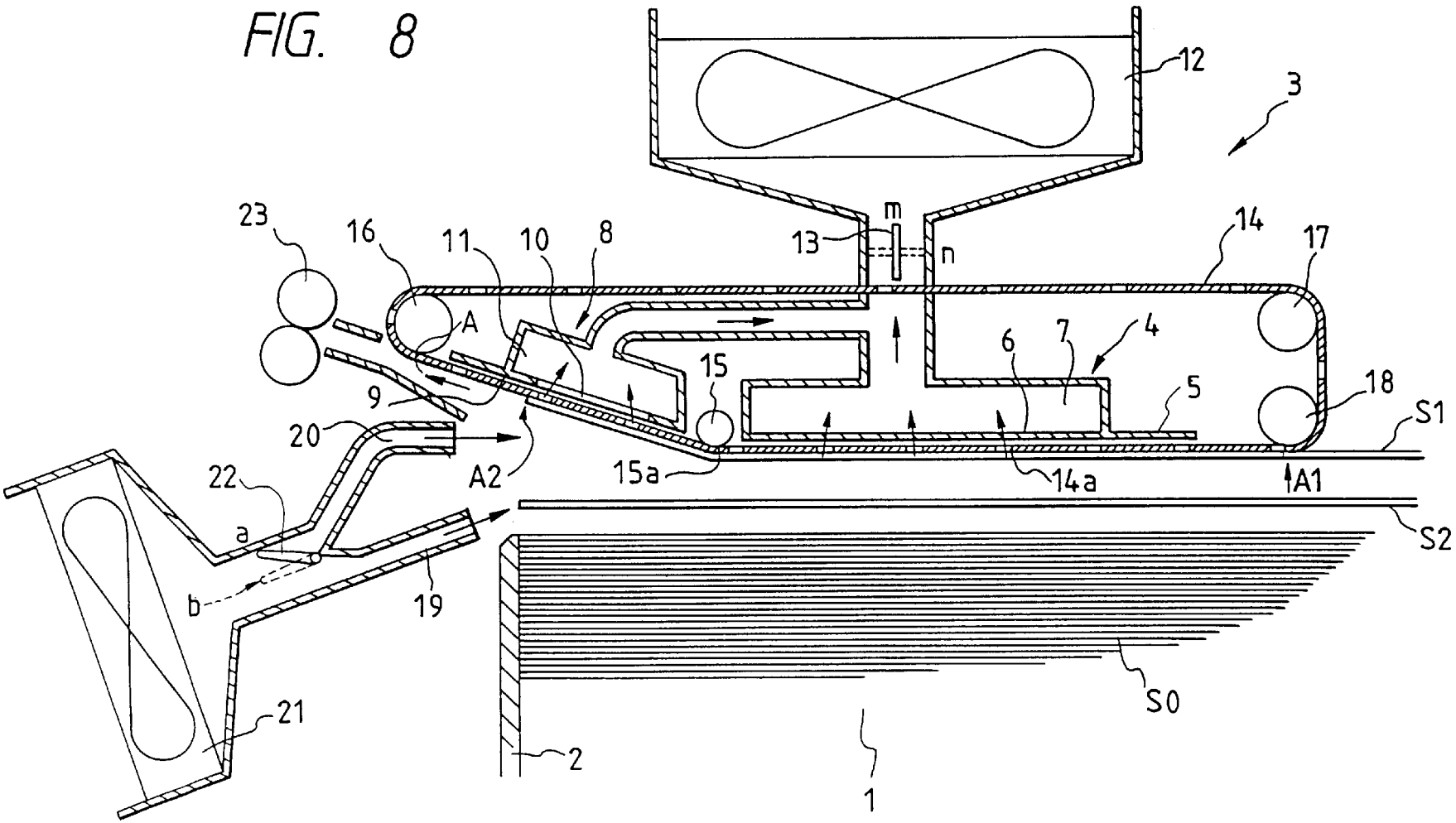
FIG. 8 is an elevational sectional view of a sheet feeding apparatus according to a second embodiment of the present invention.

Next, a second embodiment of the present invention will be explained with reference to FIG. 8.

A plurality of sheet S0 are stacked on a sheet tray 1 in such a manner that tip ends of the sheets S0 are abutted against a sheet align guide plate 2. There are provided a sheet convey portion 3, a first sheet absorb portion 4 and a second sheet absorb portion 8. The first sheet absorb portion 4 has a substantially flat bottom surface 5 opposed to the sheet stack rested on the sheet tray 1, an air suction opening 6 formed in the flat bottom surface 5 and a suction chamber 7. The second sheet absorb portion 8 is arranged at a downstream side of the first sheet absorb portion 4 in a sheet conveying direction and has a second substantially flat bottom surface 9 inclined upwardly by a predetermined angle θ with respect to the first substantially flat bottom surface 5, an air suction opening 10 formed in the second flat bottom surface 9 and a suction chamber 11. The first and second sheet absorb portions 4, 8 are connected to an air suction blower 12. The suction of the blower 12 is turned ON/OFF by a valve 13.

A convey belt 14 is mounted to covers surfaces of the first and second sheet abosrb portions 4, 8. The convey belt 14 is provided with a plurality of suction holes 14*a*. The convey belt 14 is supported by rollers 15, 16, 17 and 18 with predetermined tension and is intermittently driven in a direction shown by the arrow A by means of the drive roller (drive means) 16 to convey the sheet. The roller 15 is arranged at a junction between the first flat bottom surface 5 and the second flat bottom surface 9 and acts as a displacement fulcrum 15*a* for deforming the sheet in a downwardly convex form.

There are provided a nozzle 19 for discharging air for floating the sheets, and a contact prevent nozzle 20 for discharging air toward the proximity of a tip end of the sheet absorbed to the second sheet absorb portion. The nozzles 19, 20 are connected to an air discharge blower 21. The air discharge from the contact prevent nozzle 20 can be turned ON/OFF by a contact prevent valve 22. A pair of convey rollers 23 serve to further convey the sheet downstreamly.

Next, an operation of the air sheet feeding apparatus according to the second embodiment will be explained.

First of all, the blower 21 is operated to discharge the air from the nozzle 19 toward the tip end of the sheet stack, thereby floating several sheets from the sheet stack. Then, the valve 13 is switched to a position m by a switching means such as a solenoid (not shown) and the blower 12 is operated to suck the air through the suction openings 6, 10 and the suction holes 14*a*.

Figure 9:
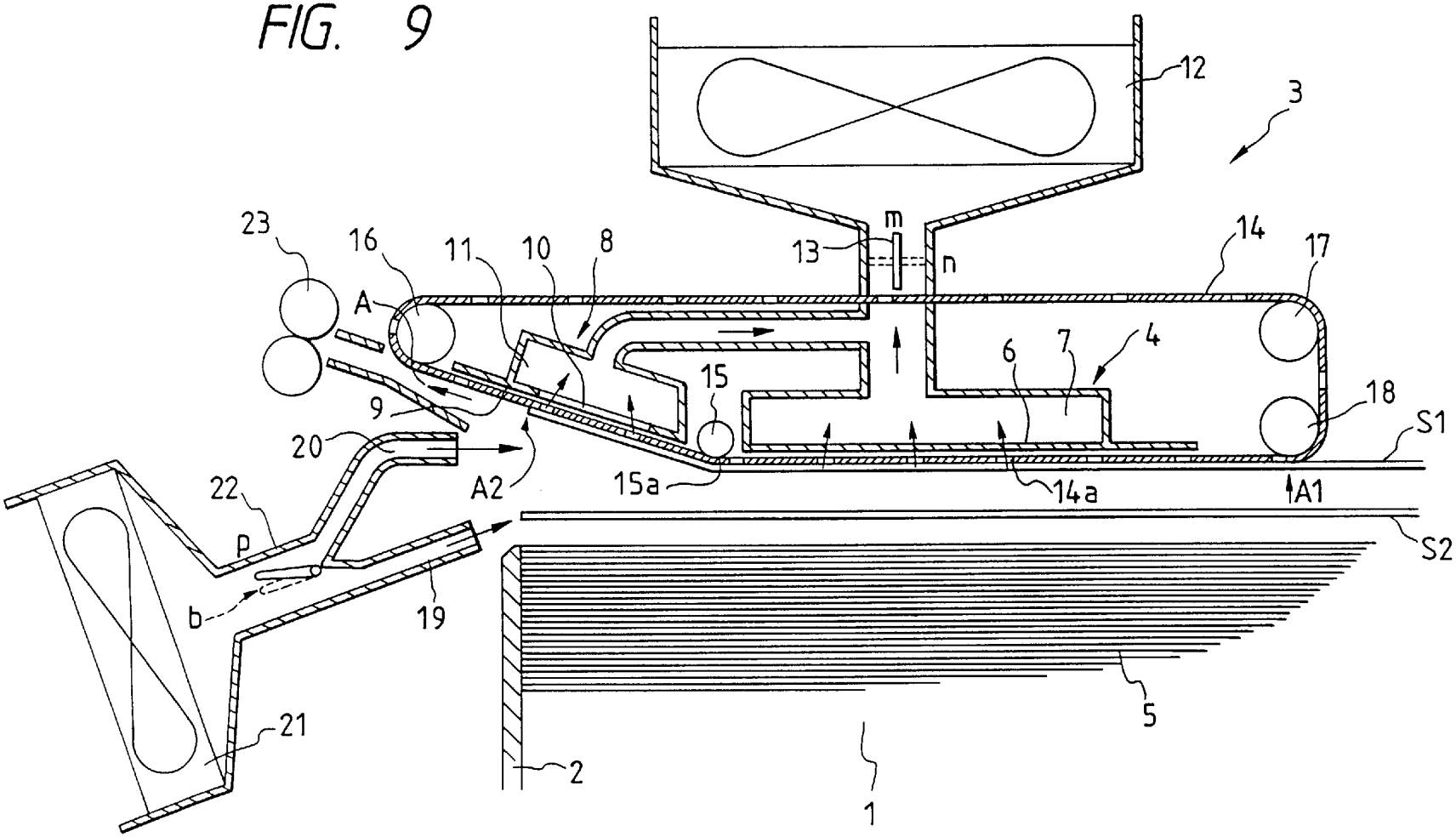
FIG. 9 is a view similar to FIG. 8, showing a condition that the air is injected from the contact preventing air blowing means even after a contact preventing valve is closed.

Consequently, the uppermost sheet S1 is absorbed to the first and second sheet absorb portions 4, 8 and is closely contacted with the convey belt 14. More specifically, as shown in FIG. 9, a central portion of the uppermost sheet is absorbed to the first sheet absorb portion 4 and a tip end portion of the sheet is absorbed to the second sheet absorb portion 8. In this case, since the absorbing forces of the first and second sheet absorb portions 4, 8 are set to be sufficiently strong, the sheet is deformed around the displacement fulcrum 15*a* in opposition to the resilience of the sheet so that the tip end portion and the central portion of the sheet can be closely contacted with the convey belt 14.

Then, the contact prevent valve 22 is opened to discharge the air from the nozzle 20 between the first sheet S1 and the second sheet S2. The convey belt 14 is driven to convey the first sheet alone to the pair of convey rollers 23. When the trailing end of the sheet being conveyed leaves the second sheet absorb means 8, the convey belt 14 is stopped.

Although the air discharge from the contact prevent nozzle 20 is stopped at this point, since the air continues to be discharged from the nozzle 20 till this point so that the second sheet S2 is not contacted with the convey belt, the problem described in connection with the prior art technique does not occur. Then, the valve 13 is closed and the absorbing forces of the first and second sheet absorb portions 4, 8 are stopped. Incidentally, when the second sheet S2 is supplied, the valve 13 is opened again to become the suction of the blower 12 effective.

In this case, if the air is discharged from the contact prevent nozzle 20, the air will flow toward the first and second sheet absorb portions 4, 8, with the result that the sheet cannot be absorbed to the sheet absorb portions or it takes a long time to absorb the sheet to the sheet absorb portions (if the sheet can eventually be absorbed). However, since the air is not discharged from the contact prevent nozzle 20, the second sheet S2 is stably contacted with the convey belt 14. Thereafter, the second sheet is conveyed in the same manner as the first sheet.

Figure 10:
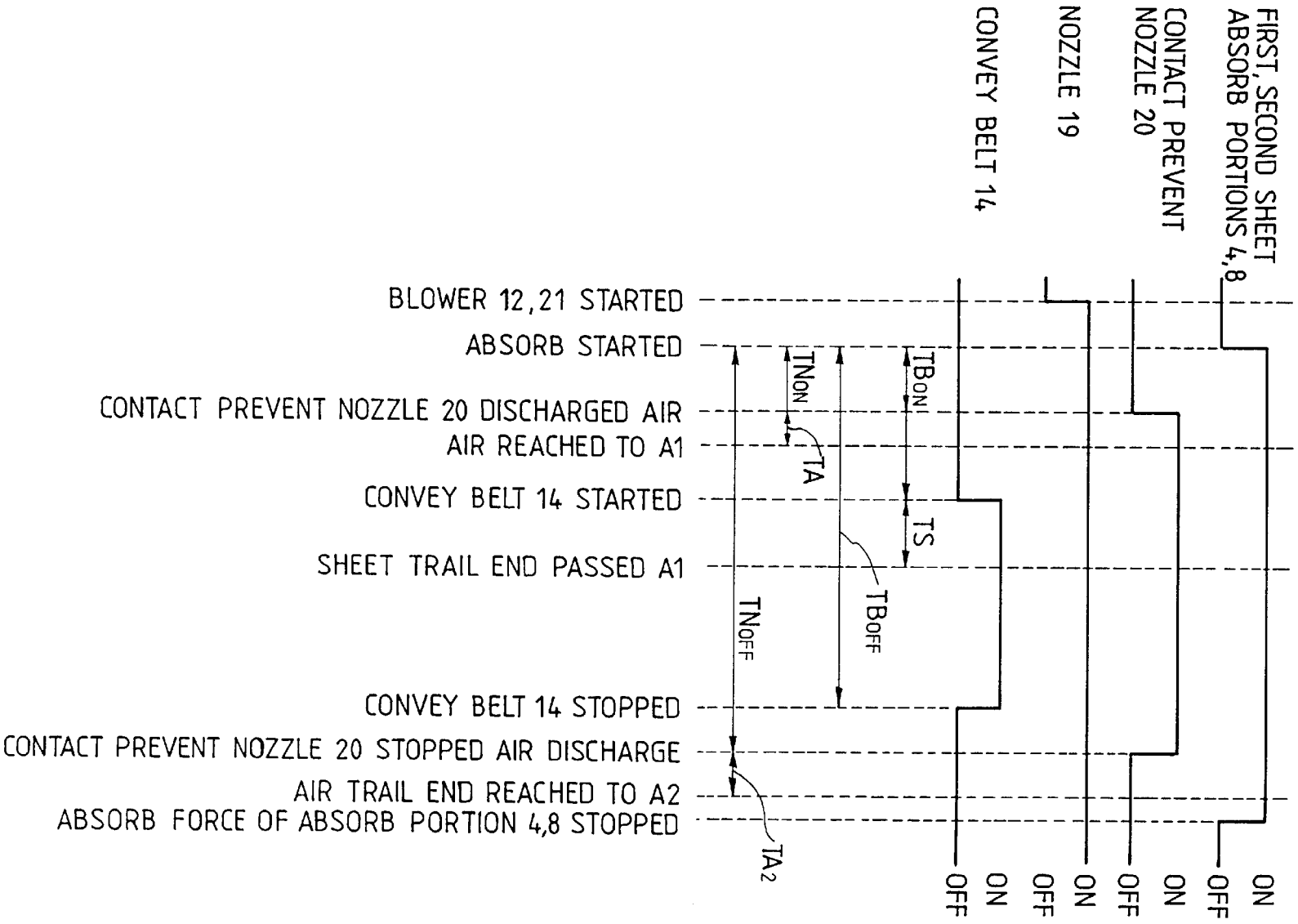
FIG. 10 is a timing chart for explaining an operation of the sheet feeding apparatus according to the second embodiment.

The timing of the operations of the belt 14 and the nozzle 20 is the same as that in the first embodiment (refer to FIG. 10).

In this embodiment, in a series of sheet supplying operations, although the absorbing forces of the first and second sheet absorb portions 4, 8 are turned ON/OFF by means of the valve 13 to control whether the absorbing forces are given to the first and second sheet absorb portions 4, 8 or not, since the air discharged from the contact prevent nozzle 20 can be turned ON/OFF to control whether the sheet is absorbed to the first and second sheet absorb portions 4, 8 or not, the stable sheet supply can be effected with the valve 13 turned ON (i.e. without the valve 13 itself).

Further, in the illustrated embodiment, while an example that the air is not discharged from the contact prevent nozzle 20 at all when the contact prevent valve 22 is closed was explained, when the sheet is to be absorbed to the first and second sheet absorb portions 4, 8, a little amount of air may be discharged from the nozzle by slightly opening the contact prevent valve 22, as shown by "p" in FIG. 11, so long as the absorption of the sheet is not prevented. By doing so, the opening/closing movement of the contact prevent valve 22 can respond more quickly.

As mentioned above, since the amount of air discharged from the air blowing means for discharging the air toward the top end of the sheet absorbed to the sheet absorb means to cover the sheet absorb means is smaller when the sheet is absorbed to the sheet absorb means than when the sheet absorbed to the sheet absorb means is conveyed by the convey means, the contact between the second sheet and the convey means is prevented, thereby stably conveying the sheet.

What is claimed is:

1. A sheet feeding apparatus comprising:

sheet supporting means for supporting a plurality of sheets;

sheet absorb means for absorbing an uppermost sheet of the sheets supported by said sheet supporting means under the action of air suction;

convey means for conveying the sheet absorbed by said sheet absorb means;

contact preventing air blowing means for discharging air between the sheet absorbed by said sheet absorb means and a next sheet so that the next sheet is not conveyed by said convey means while the sheet absorbed by said sheet absorb means is conveyed by said convey means;

air adjusting means for adjusting an amount of air discharged from said contact preventing air blowing means; and control means for controlling said air adjusting means so that the amount of the air discharged from said contact preventing air blowing means between the sheet conveyed by said convey means and the next sheet is increased before a trailing end of said conveyed sheet reaches said sheet absorb means, and the amount of the discharged air is decreased after said convey means stopped.

2. A sheet feeding apparatus according to claim 1, wherein, said control means controls said air adjusting means so that when it is assumed that a time period from initiation of the absorption of said sheet absorb means to initiation of increase in the air discharge from said contact preventing air blowing means is $TN_{ON}$, a time period from initiation of the absorption of said sheet absorb means to initiation of decrease in the air discharge from said contact preventing air blowing means is $TN_{OFF}$, a time period from initiation of the absorption of said sheet absorb portion to initiation of movement of said convey means is $TB_{ON}$, a time period from initiation of the absorption of said sheet absorb portion to the stop of the convey means is $TB_{OFF}$, a time period from initiation of movement of said convey means to the passage of the trailing end of the sheet through a rear end of a contact area between the sheet and said convey means is TS, a time period from initiation of increase in the air discharge from said contact preventing air blowing means to the reach of the increased discharged air to the rear end of the contact area between the sheet and said convey means is TA1, and a time period from initiation of decrease in the air discharge from said contact preventing air blowing means to the reach of the decreased discharged air to a front end of the contact area between the sheet and said convey means is TA2, said air adjusting means increases or decreases an amount of air discharged from said contact preventing air blowing means to satisfy the following two relations during the conveyance of the sheet;

$$TN_{ON}+TA1 \leqq TB_{ON}+TS \quad \text{(i)}$$

$$TB_{OFF} \leqq TA2+TN_{OFF} \quad \text{(ii)}$$

3. A sheet feeding apparatus according to claim 1 or 2, wherein said contact preventing air blowing means has an air blowing blower, and a nozzle for discharging the air blown from said blower toward tip ends of the sheets supported by said sheet supporting means.

4. A sheet feeding apparatus according to claim 3, further comprising an openable valve arranged between said air blowing blower and said nozzle, and increase and decrease in the amount of air discharged from said contact preventing air blowing means is adjusted by said openable valve.

5. A sheet feeding apparatus according to claim 3, wherein a sheet floating nozzle for discharging air against the tip ends of the sheets supported by said sheet supporting means to float several sheets is connected to said air blowing blower.

6. A sheet feeding apparatus according to claim 1, wherein said sheet absorb means has a suction chamber, and a suction blower for sucking air from said suction chamber.

7. A sheet feeding apparatus according to claim 6, wherein said convey means has a convey belt mounted to close a suction opening of said suction chamber and having a plurality of suction holes formed therein, and the sheet is conveyed by rotating said convey belt.

8. A sheet feeding apparatus according to claim 1, wherein said sheet absorb means includes a first sheet absorb portion for absorbing the sheet supported by said sheet supporting means under the action of air suction, and a second sheet absorb portion arranged downstream of said first sheet absorb portion to absorb a tip end portion of the sheet absorbed by said first sheet absorb portion to deform the sheet.

9. A sheet feeding apparatus according to claim 8, wherein said first sheet absorb portion includes a first suction chamber connected to a suction blower, and said second sheet absorb portion includes a second suction chamber connected to a or said suction blower.

10. A sheet feeding apparatus according to claim 6, wherein said convey means has a convey belt mounted to close suction openings of said first and second suction chambers and having a plurality of suction holes formed therein, and the sheet is conveyed by rotating said convey belt.

11. A sheet feeding apparatus according to claim 1, wherein said contact prevent air blowing means is controlled to adjust the amount of the discharged air between zero and a predetermined value which can separate the sheets.

12. A sheet feeding apparatus according to claim 1, wherein said contact prevent air blowing means is controlled to adjust the amount of the discharged air between a minimum value which does not block an absorbing operation of said sheet absorb means and a predetermined value which can separate the sheets.

13. An image forming apparatus comprising:

sheet supporting means for supporting a plurality of sheets;

sheet absorb means for absorbing an uppermost sheet of the sheets supported by said sheet supporting means under the action of air suction;

convey means for conveying the sheet absorbed by said sheet absorb means;

contact preventing air blowing means for discharging air between the sheet absorbed by said sheet absorb means and a next sheet so that the next sheet is not conveyed by said convey means while the sheet absorbed by said sheet absorb means is conveyed by said convey means;

air adjusting means for adjusting an amount of air discharged from said contact preventing air blowing means;

control means for controlling said air adjusting means so that the amount of the air discharged from said contact preventing air blowing means between the sheet conveyed by said convey means and the next sheet is increased before a trailing end of said conveyed sheet reaches said sheet absorb means, and the amount of the discharged air is decreased after said convey means stopped; and image forming means for forming an image on a sheet fed by said sheet feeding apparatus.

* * * * *

UNITED STATES PATENT AND TRADEMARK OFFICE

CERTIFICATE OF CORRECTION

PATENT NO. : 6,082,728

DATED : July 4, 2000

INVENTOR(S): SHINSUKE UBAYASHI

It is certified that error appears in the above-identified patent and that said Letters Patent is hereby corrected as shown below:

COVER PAGE AT ITEM [56] RC:
Foreign Patent Documents: "07101579" should read --7-101579--.

COLUMN 1:
Line 62, "pait" should read --pair--.

COLUMN 5:
Line 27, "sheet S0" should read --sheets S0--;
Line 45, "covers" should read --cover--; and
Line 46, "abosrb" should read --absorb--.

Signed and Sealed this

Tenth Day of April, 2001

*Attest:*

Nicholas P. Godici

NICHOLAS P. GODICI

*Attesting Officer*

*Acting Director of the United States Patent and Trademark Office*